US011147406B2

(12) United States Patent
Padan

(10) Patent No.: US 11,147,406 B2
(45) Date of Patent: Oct. 19, 2021

(54) APPARATUS FOR FASTENING A STRAP OF AN ARM PHYLACTERY

(71) Applicant: Eliyahu Padan, Ramat Hasharon (IL)

(72) Inventor: Eliyahu Padan, Ramat Hasharon (IL)

(73) Assignee: Eliyahu Padan, Ramat Hasharon (IL)

( * ) Notice: Subject to any disclaimer, the term of this patent is extended or adjusted under 35 U.S.C. 154(b) by 0 days.

(21) Appl. No.: 17/007,531

(22) Filed: Aug. 31, 2020

(65) Prior Publication Data

US 2021/0085115 A1 Mar. 25, 2021

Related U.S. Application Data

(60) Provisional application No. 62/904,201, filed on Sep. 23, 2019.

(51) Int. Cl.

| | |
|---|---|
| ***A47G 33/00*** | (2006.01) |
| ***A44B 11/06*** | (2006.01) |
| ***A41F 1/00*** | (2006.01) |

(52) U.S. Cl.

CPC ..... *A47G 33/008* (2013.01); *A41F 1/002* (2013.01); *A44B 11/06* (2013.01)

(58) Field of Classification Search

CPC ..... A44B 11/06; A41F 1/002; A47G 33/008
See application file for complete search history.

(56) References Cited

U.S. PATENT DOCUMENTS 1,347,827 A * 7/1920 Raymer ..... 24/168
5,618,263 A * 4/1997 Alivizatos ..... A61F 5/05841 128/878
5,697,962 A * 12/1997 Brink ..... A61F 7/02 126/204
6,131,249 A * 10/2000 Suenaga ..... A42B 1/22 24/306
6,138,331 A * 10/2000 Powers ..... A44B 11/2576 24/306
6,551,234 B1 4/2003 Martello
6,602,213 B1 * 8/2003 Figley ..... A61F 5/05841 602/14
6,606,767 B2 8/2003 Wong
6,622,349 B2 9/2003 Wong
6,945,988 B1 * 9/2005 Jones ..... A61F 7/10 607/108
8,397,357 B1 * 3/2013 Madey ..... A43C 7/04 24/712.3

(Continued)

*Primary Examiner* — Jason W San

(74) *Attorney, Agent, or Firm* — M&B IP Analysts, LLC

(57) ABSTRACT

An apparatus for fastening an end of a strap is provided. The apparatus comprises a workpiece, a first slit at a proximity of an edge of a first rectangle of the workpiece, a second slit at a proximity of an edge of a second rectangle of the workpiece opposite to first rectangle, a first fastening member affixed to a third rectangle of the workpiece perpendicular to the first and second rectangles, and a second fastening member affixed to a fourth rectangle of the workpiece opposite of the third rectangle. The fourth rectangle adapted to fold over so that the first fastening member and the second fastening member may engage to lock the strap. The strap may be inserted through the first slit and the second slit and its end held in position when the fastening members are engaged. In an embodiment, the strap is of a phylactery.

17 Claims, 3 Drawing Sheets

(56) References Cited

U.S. PATENT DOCUMENTS

| | | | | |
|---|---|---|---|---|
| 8,789,690 | B2 * | 7/2014 | Adler | A47G 33/00 206/8 |
| 10,080,390 | B2 * | 9/2018 | LaHann | A41F 19/00 |
| 10,085,581 | B2 * | 10/2018 | Greenberg | A47G 33/008 |
| 2005/0102802 | A1 * | 5/2005 | Sitbon | A44C 5/2071 24/303 |
| 2009/0114690 | A1 * | 5/2009 | Landay | A45C 13/30 224/575 |
| 2011/0016676 | A1 * | 1/2011 | Gray | B60P 7/0869 24/571 |
| 2011/0314640 | A1 * | 12/2011 | Reynolds | B25G 1/102 16/430 |
| 2012/0000799 | A1 * | 1/2012 | Adler | A47G 33/00 206/19 |
| 2012/0030908 | A1 | 2/2012 | Harush et al. | |
| 2012/0084948 | A1 * | 4/2012 | Breen, IV | A44B 11/06 24/16 R |
| 2012/0310201 | A1 * | 12/2012 | Oates | A61F 13/5514 604/385.02 |
| 2015/0047161 | A1 * | 2/2015 | Hillegonds | A44B 11/006 29/3 |
| 2015/0359373 | A1 * | 12/2015 | Greenberg | A47G 33/008 428/3 |
| 2017/0119067 | A1 * | 5/2017 | LaHann | A41F 1/002 |
| 2021/0186234 | A1 * | 6/2021 | Dolk | A44B 11/06 |
| 2021/0204627 | A1 * | 7/2021 | Linchitz | A41D 3/005 |

* cited by examiner

APPARATUS FOR FASTENING A STRAP OF AN ARM PHYLACTERY

CROSS-REFERENCE TO RELATED APPLICATIONS

This application claims the benefit of U.S. Provisional Application No. 62/904,201 filed on Sep. 23, 2019, the contents of which are hereby incorporated by reference.

TECHNICAL FIELD

The present disclosure generally relates to an accessory for phylacteries and more specifically for devices for securing the strap of an arm phylactery in place.

BACKGROUND

As part of the Jewish tradition, phylacteries are being placed, one for the head and another for the arm as part of the morning services. The phylacteries are different by design, where the head phylactery having a box containing four scribed parchment scrolls and connected to two straps that are adapted to fit around the circumference of the head, with the straps continuing downwards along both sides of the person's neck and around the person's chest.

The arm phylactery comprises a box, containing therein a single parchment scroll, and a strap connected thereto. The strap is then twisted around the upper arm and the forearm. The rest of the strap is then twisted around the hand to form a particular shape, and then the excess of the strap thereof is then wound around the palm of the hand. The excess end of the strap is then tucked between the winding of the strap and the palm of the hands.

A person who uses an arm phylactery regularly will readily appreciate the discomfort caused by the tucking in the edge of the strap of the arm phylactery between the windings of the strap and the palm of the hand.

It would therefore be advantageous to provide a solution that secures the edge of the strap of the arm phylactery in place without having to tuck it between the windings of the strap and the palm of the hand.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Some embodiments disclosed herein include an apparatus for fastening a strap comprising a first workpiece that further including: a first rectangle portion, a second rectangle portion extending from a first side of the first rectangle portion, a third rectangle portion extending from a second side of the first rectangle portion, a fourth rectangle portion extending from a third side of the first rectangle portion, and a fifth rectangle portion extending from a fourth side of the first rectangle portion, wherein the first side and the third side are opposite sides of the first rectangle portion, and wherein the second side and the fourth side are opposite sides of the first rectangle portion; a first slit at a proximity of a first edge of the second rectangle, wherein the first slit is adapted to accept the strap therethrough; a second slit at a proximity of a first edge of the fourth rectangle, wherein the first slit is adapted to accept the strap therethrough; a first fastening member attached to the third rectangle portion; and a second fastening member attached to the fifth rectangular portion; wherein the third rectangle portion comprising a folding area about the second side of the first rectangle portion to allow the third rectangle portion to fold about the folding area such that the first fastening member and the second fastening member may engage such that the strap is fastened between the first rectangle portion and the third rectangle portion.

Some embodiments disclosed herein also include an apparatus for fastening a strap. The apparatus comprising: a first workpiece that further comprises: a first rectangle portion, a second rectangle portion extending from a first side of the first rectangle portion, a third rectangle portion extending from a second side of the first rectangle portion, and a fourth rectangle portion extending from a third side of the first rectangle portion, wherein the first side and the third side are opposite sides of the first rectangle portion, and wherein the second side is perpendicular to the first side; a first slit at a proximity of a first edge of the second rectangle, wherein the first slit is adapted to accept the strap therethrough; a second slit at a proximity of a first edge of the fourth rectangle, wherein the first slit is adapted to accept the strap therethrough; a first fastening member attached to the third rectangle portion; and a second fastening member attached to the first rectangular portion; wherein the third rectangle portion comprising a folding area about the second side of the first rectangle portion to allow the third rectangle portion to fold about the folding area such that the first fastening member and the second fastening member may engage such that the strap is fastened between the first rectangle portion and the third rectangle portion.

BRIEF DESCRIPTION OF THE DRAWINGS

The subject matter that is regarded as the disclosure is particularly pointed out and distinctly claimed in the claims at the conclusion of the specification. The foregoing and other objects, features, and advantages of the disclosure will be apparent from the following detailed description taken in conjunction with the accompanying drawings.

DETAILED DESCRIPTION

Figure 1:
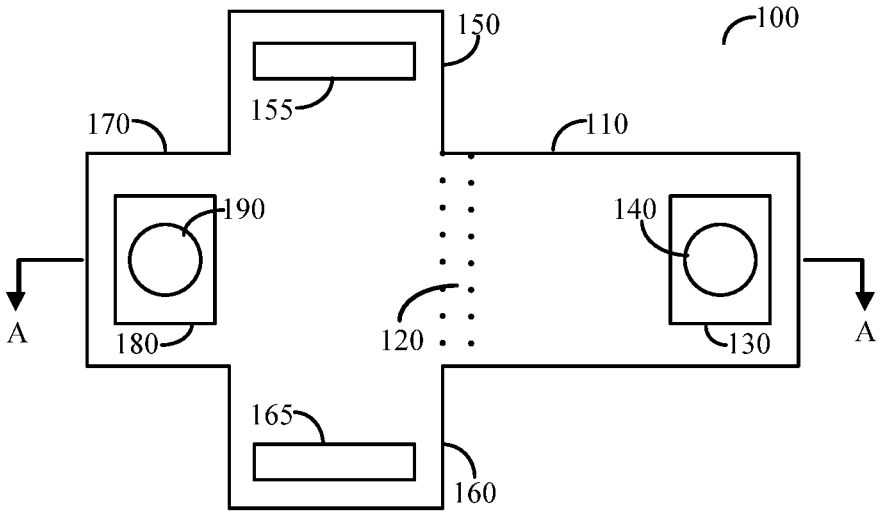
FIG. 1 is a top view of a first workpiece of a fastening apparatus for an arm phylactery according to an embodiment.

The embodiments disclosed herein are only examples of the many possible advantageous uses and implementations of the innovative teachings presented herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

An apparatus is designed to be fitted to a strap of an arm phylactery using two slits therein and a locking mechanism that locks the excess end of the strap wound around the palm of the hand using magnets that are embedded in the apparatus. The arm phylactery includes of a box, containing therein a parchment scroll, and a strap connected thereto. The strap and box are made of animal hide and are connected so that the box can be placed on the upper arm. The strap is then twisted around the upper arm and the forearm. The remaining of the strap is then twisted around the hand in a particular fashion and then wound around the palm of the hand. The apparatus is then used to fasten the excess end of the strap into place. The locking mechanism may be mechanical or magnetic.

FIG. 1 depicts an example top view of a first workpiece 100 of a fastening apparatus for an arm phylactery according to an embodiment. The first workpiece 100 is a cruciform typically made of animal hide, but not limited thereto. The cruciform includes of a first rectangle piece 110, a second rectangle piece 150, a third rectangle piece 160 and a forth rectangle piece 170. Rectangle piece 150 has therein a slit 155 and rectangle piece 160 has therein a slit 165. The slits 155 and 165 are adapted to allow a strap, for example but without limitation the strap of the arm phylactery to be thread therethrough towards the edge of the strap that is the farthest from the box of the arm phylactery.

In one embodiment a pad 130 made of, for example but not by way of limitation, plastic, resin, rubber, animal hide, and like materials, is placed towards the far edge of the rectangle 110 on top of which a magnet 140 is placed thereon. The magnetic field of the magnet being directed perpendicular to the rectangle piece 110. In one embodiment a pad 180 made of, for example but not by way of limitation, of plastic, resin, rubber, animal hide and like materials, is placed at the center of the rectangle piece 170 on top which a magnet 190 is placed thereon.

The magnetic field of the magnet is perpendicular directed to the rectangle piece 170. The magnetic pole of the magnet 140 and magnet 190 are to be opposite of each other so that when brought in proximity of each other the magnet 140 and the magnet 190 are attracted to each other. In one embodiment, any one of the pads 130 and 180 may or may not be present.

It should be readily appreciated that though pads 130 and 180 are described herein as having a rectangle shape are merely for examples and other shapes are applicable. The first workpiece 100 is adapted to fold about rectangle piece 150, such that the magnet 140 can be brought into proximity of magnet 190.

It should readily appreciate that the first pole of a magnet can be a North pole and a second pole of the magnet can be a South pole, as is well known in the art of magnets. Furthermore, while the embodiment described herein requires two magnets, and embodiment where one of the first magnet and the second magnet is replaced by a ferromagnetic material.

Figure 2:
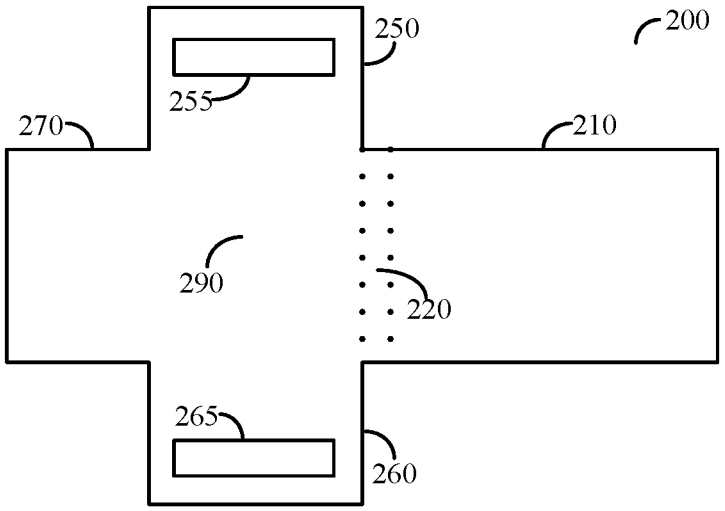
FIG. 2 is a top view of a second workpiece of the fastening apparatus for an arm phylactery according to an embodiment.

FIG. 2 is an example top view of a second workpiece 200 of the fastening apparatus for an arm phylactery according to an embodiment. The second workpiece 200 is to be attached on top of the first workpiece 100 such that at least the magnet 140 and the magnet 190 are secured in place therebetween. The attachment can be achieved for example, but not by way of limitation, by gluing or stitching the first workpiece 100 to the second workpiece 200.

In another embodiment, the attachment is achieved by applying pressure, which may further include the application of heat. The second workpiece 200 is designed to correspond to first workpiece 100 such that rectangle piece 210 fits over rectangle piece 110, rectangle piece 250 fits over rectangle piece 150 such that slit 255 corresponds to slit 155, rectangle piece 270 fits over rectangle piece 170; and, rectangle piece 260 fits over rectangle piece 160 such that slit 265 corresponds to slit 165. The second workpiece 200, like its counterpart first workpiece 100, is adapted to fold at rectangle piece 220 so as to bring the far end of rectangle piece 210 toward the far end of rectangle piece 270.

Figure 3:
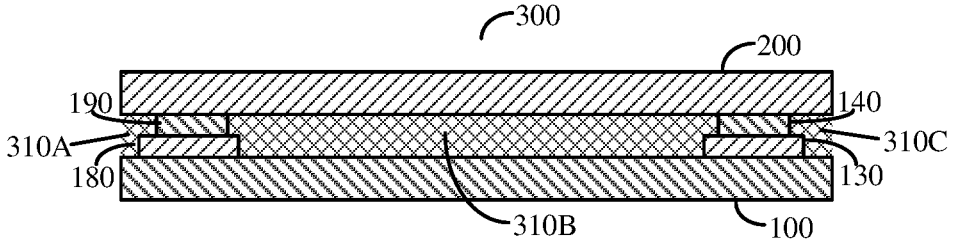
FIG. 3 is a cross-section view of the apparatus including the first workpiece and the second workpiece one on top of the other forming a complete fastening apparatus for an arm phylactery according to an embodiment.

FIG. 3 includes an example cross-section view A-A (see FIG. 1) of the apparatus comprising the first workpiece and the second workpiece one on top of the other forming a complete fastening apparatus for an arm phylactery according to an embodiment. An adhesive 310 (shown in 310A, 3108, and 310C) is used to allow as an adhesive to connect between the two workpieces 100 and 200 and thus securing at least the magnets 140 and 190 in place.

In one embodiment, the first workpiece 100 and the second workpiece 200 are pressed towards each other, for example but not by way of limitation, in a pressing machine, which may, in one embodiment, further involve heating of the apparatus 300. In another embodiment the attachment of the first workpiece 100 to the second workpiece 200 is achieved by stitching them together thereby securing a bonding thereto. It should be readily appreciated that combinations of attachment techniques may be used without departing from the scope of the disclosed embodiments.

Figure 4:
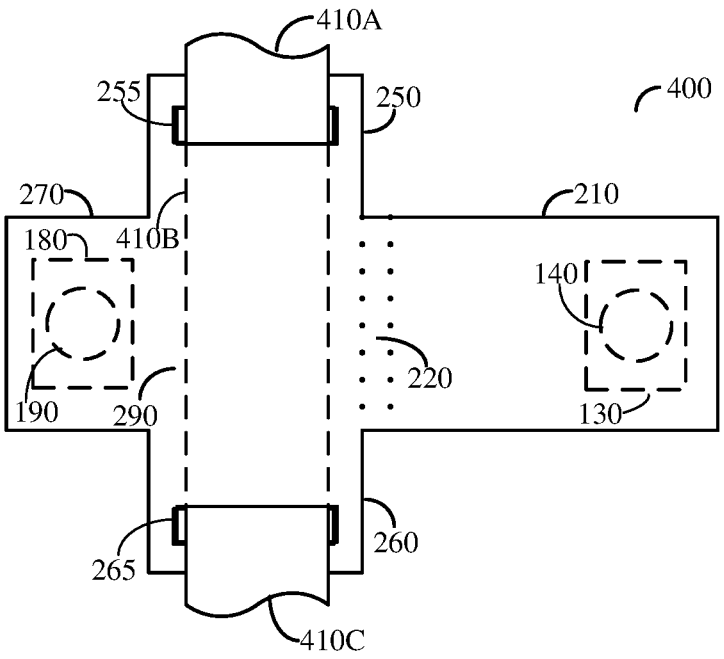
FIG. 4 is a top view of an unfolded fastening apparatus for an arm phylactery according to an embodiment showing the arm strap threaded thereto.

FIG. 4 depicts an example top view of an unfolded fastening apparatus 400 for an arm phylactery according to an embodiment showing the arm strap 410 threaded thereto. The strap of the arm phylactery 410 is threaded through the slit and emerges through the slit 265 so that the strap portion 410A is inserted into the slit 255 and continues at the bottom of the fastening apparatus 400, shown as strap portion 410B, and then emerging from slit 265 as strap portion 410C. One of ordinary skill in the art would readily appreciate that while a strap of an arm phylactery is described herein, other straps may be used without departing from the scope of the disclosed embodiments.

Figure 5:
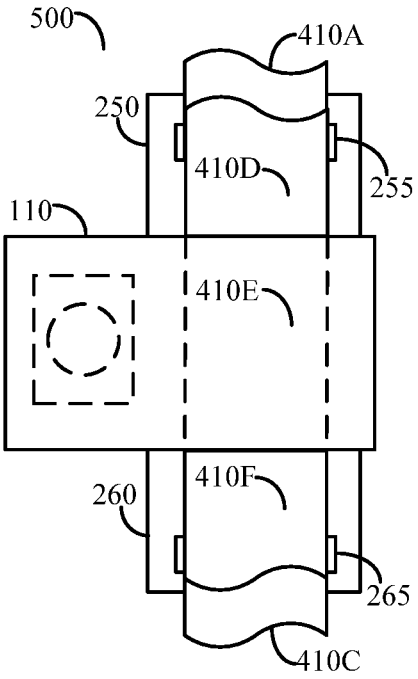
FIG. 5 is a top view of a folded fastening apparatus for an arm phylactery according to an embodiment showing the excess end of the arm strap fastened thereby.

FIG. 5 is an example top view of a folded fastening apparatus 500 for an arm phylactery according to an embodiment showing the excess end of the arm strap fastened thereby. The rectangle piece 110, and its corresponding edge of rectangle piece 210 (not seen as it is behind the rectangle piece 110) is folded such that its far edge meets the far edge of rectangle pieces 170 and 270 (which are not seen as they are both obstructed from view by rectangle piece 110). The excess end of the arm strap is secured at the flat rectangle piece 290 (not seen here but seen in FIG. 2) and the rectangle piece 210 when folded thereupon. The excess end of the arm strap comprises workpieces 410D, 410E, and 410F, wherein the workpiece 410E is secured between the rectangle piece 290 and the rectangle piece 210 when folded, and wherein the strap workpieces 410D and 410F extended outwards therefrom.

Because of the nature of the animal hide of which the apparatus is preferably made of, as well as the arm strap itself, there is enough friction to safely hold the excess end of the arm strap in place, thereby solving the problem of the prior art that requires stuffing the excess end of the arm strap between the windings of the hand strap and the palm of the hand. In the case wherein insufficient friction is anticipated embodiments may use materials having a higher friction coefficient, or creating a surface that increases friction, for example a rugged surface. While preferable material for the apparatus is animal hide other materials may be used without departing from the disclosed embodiments.

Figure 6:
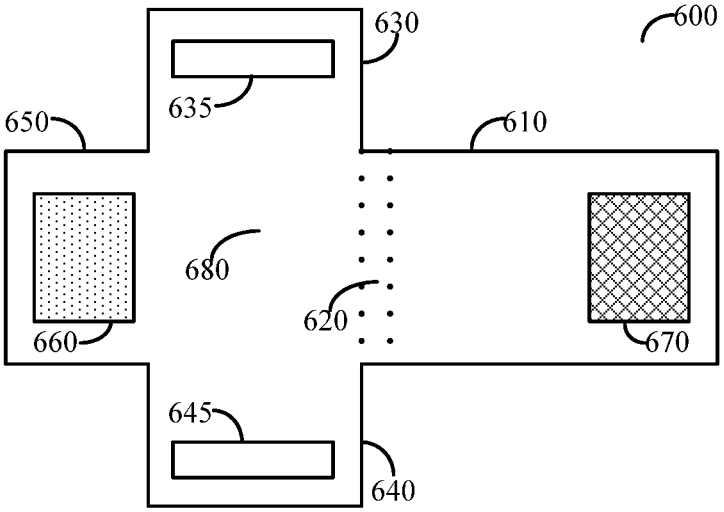
FIG. 6 is a top view of a third workpiece of a fastening apparatus for an arm phylactery according to an embodiment.

FIG. 6 depicts an example top view of a third workpiece 600 of a fastening apparatus for an arm phylactery according to an embodiment. The third workpiece 600 may have a cruciform shape as discussed herein, and further includes a slit 635 and a slit 645 through which a strap may be inserted therethrough, in ways similar to those explained herein. The slits 635 and 645 are positioned within rectangle pieces 630 and 640 respectively of the third workpiece 600. A first fastening member 660 and a second fastening member 670 are adapted to connect upon folding of rectangle piece 610 over towards rectangle piece 650 causing the first fastening member 660 and the second fastening member 670 to engage therewith.

A strap placed upon the longitude of rectangle piece 630 towards rectangle piece 640 is therefore secured in place. The first fastening member 660 and the second fastening member 670 may comprise of various devices that allow such forceful fastening but that also detach upon applying a separation force, allowing the release of the strap fastened between rectangle piece 610 and rectangle piece 680. Therefore, such fastening members may include, but are not limited to, an adhesive strip, a Velcro® hook, a loop fastener, a hook, a clip, a clamp, a zipper track, and the like.

Figure 7:
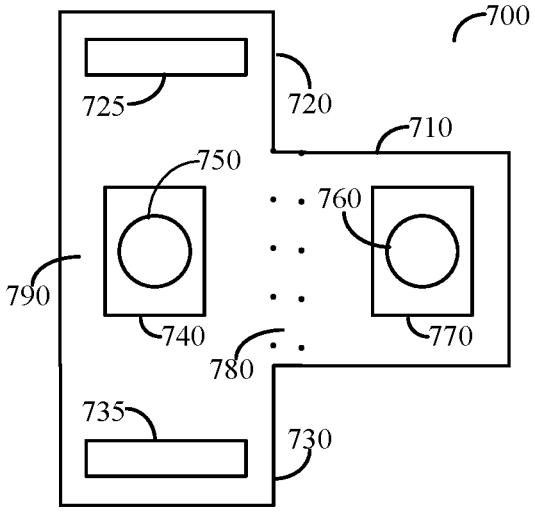
FIG. 7 is a top view of a fourth workpiece of a fastening apparatus for an arm phylactery according to an embodiment.

FIG. 7 shows an example top view of a fourth workpiece 700 of a fastening apparatus for an arm phylactery according to an embodiment. A T-shaped workpiece 700 includes a first rectangle piece 710, and a second rectangle piece 720, and a third rectangle piece 730. A folding rectangle piece 780 within the rectangle piece 710 allows the folding of the rectangle piece 710 towards the top of the T-shaped workpiece 700 extending between the second rectangle piece 720 and the third rectangle piece 730.

A first magnet 750 having a first pole and a second pole is placed on top of area 790 of the T-shaped workpiece 700 having the first pole facing the T-shaped workpiece 700. In one embodiment a pad 740 is placed between the T-shaped workpiece 700 and the magnet 750. A second magnet 760 having a first pole and a second pole is placed on top of the rectangle piece 710 of the T-shaped workpiece 700 having the second pole facing the T-shaped workpiece 700.

In one embodiment, a pad 770 is placed between the T-shaped workpiece 700 and the second magnet 760. The magnets 750 and 760 are placed such that when the rectangle piece 710 is folded about the folding axis 780, towards rectangle area 790, the opposite poles of the magnets 750 and 760 attract and connect. A corresponding T-shaped workpiece having also slits corresponding to the slits 725 and 735 of the fourth workpiece 700 is attached to the fourth workpiece 700 to complete the fastening apparatus. Such attachment may take place in ways described herein for previous embodiments and are therefore not repeated here. It should be noted that a strap (not shown) may be inserted into slit 725 and then emerging from slit 735, similarly to the fashion explained with respect of FIG. 4.

It should be further appreciated that the apparatus disclosed herein may be used to fasten also other kinds of straps without departing from the scope of the disclosed embodiments. Furthermore, while a particular shape of the first workpiece and the second workpiece have been disclosed herein, other shapes may be used to generally provide for the threading through a first slit and a second slit a strap and fasten it to the apparatus by means of closing thereon by magnets connecting at opposing poles.

In one embodiment material for increasing the friction between the areas of the apparatus coming in contact with the excess end of the strap may be used for the purpose of better securing of the excess end of the strap in place. Yet furthermore, although the description herein discussed the case of an arm phylactery one of ordinary skill in the art would readily appreciate that the apparatus may be used for a head phylactery which is specifically within the scope of this disclosure. The use of the apparatus in general, and specifically with respect of a phylactery is not limited for use when wearing a phylactery and, for example and without limitation, is envisioned to be used also for storage purposes. Although round magnets are shown in the drawings other shaped magnets may equally be used without departing from the scope of the disclosed embodiments.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. An apparatus for fastening a strap, comprising:

a first workpiece that further including: a first rectangle portion, a second rectangle portion extending from a first side of the first rectangle portion, a third rectangle portion extending from a second side of the first rectangle portion, a fourth rectangle portion extending from a third side of the first rectangle portion, and a fifth rectangle portion extending from a fourth side of the first rectangle portion, wherein the first side and the third side are opposite sides of the first rectangle portion, and wherein the second side and the fourth side are opposite sides of the first rectangle portion;

a first slit at a proximity of a first edge of the second rectangle, wherein the first slit is adapted to accept the strap therethrough;

a second slit at a proximity of a first edge of the fourth rectangle, wherein the first slit is adapted to accept the strap therethrough;

a first fastening member attached to the third rectangle portion; and a second fastening member attached to the fifth rectangular portion;

wherein the third rectangle portion comprising a folding area about the second side of the first rectangle portion to allow the third rectangle portion to fold about the folding area such that the first fastening member and the second fastening member may engage such that the strap is fastened between the first rectangle portion and the third rectangle portion.

2. The apparatus of claim 1, wherein the first workpiece is made of animal hide.

3. The apparatus of claim 1, wherein the strap is a strap of a phylactery.

4. The apparatus of claim 3, wherein the phylactery is an arm phylactery.

5. The apparatus of claim 3, wherein the phylactery is a head phylactery.

6. The apparatus of claim 1, wherein the first workpiece has a cruciform shape.

7. The apparatus of claim 1, wherein the first fastening member comprises:

a first magnet having a first pole and a second pole positioned at a proximity of a third edge of the first workpiece, wherein the first pole faces the first workpiece.

8. The apparatus of claim 1, wherein the second fastening member comprises:

a second magnet having a first pole and a second pole positioned at a proximity of the fourth edge of the first workpiece, wherein the second pole faces the first workpiece.

9. The apparatus of claim 1, wherein the second fastening member comprises of a ferromagnetic material.

10. The apparatus of claim 1, further comprises:

a second workpiece having a shape essentially corresponding to first workpiece, and further having a third slit essentially corresponding to the first slit and a fourth slit essentially corresponding to the second slit, the second workpiece attached to the first workpiece over the first fastening member and the second fastening member, wherein the second workpiece is adapted to fold about a second axis, the second axis being parallel correspondence to the folding area of the third rectangle portion.

11. The apparatus of claim 10, wherein the first workpiece and the second workpiece are made of animal hide.

12. The apparatus of claim 1, wherein the first workpiece has a cruciform shape.

13. The apparatus of claim 10, wherein the second workpiece is attached to the first workpiece by at least one of: a plurality of stiches, an adhesive, by compression.

14. The apparatus of claim 1, wherein a first pad is placed between the first fastening member and the first workpiece.

15. The apparatus of claim 14, wherein the first pad is made of material including any one of: animal hide, plastic, resin, and rubber.

16. The apparatus of claim 1, wherein a second pad is placed between the second fastening member and the first workpiece.

17. The apparatus of claim 16, wherein the second pad is made of at least one of:

animal hide, plastic, resin, or rubber.

* * * * *